US005758856A

United States Patent [19]

Carnahan et al.

[11] Patent Number: 5,758,856

[45] Date of Patent: Jun. 2, 1998

[54] PEDESTAL

[76] Inventors: Garnett Carnahan; Caroline Carnahan, both of 337 E. Lindbergh Rd., Nixa, Mo. 65714

[21] Appl. No.: 645,485

[22] Filed: May 13, 1996

[30] Foreign Application Priority Data

Mar. 19, 1996 [CN] China ..... 96 2 29481.0

[51] Int. Cl.[6] ..... B63B 17/00

[52] U.S. Cl. ..... 248/523; 114/363; 248/158; 248/188.1; 403/344

[58] Field of Search ..... 248/158, 159, 248/188.1, 188.8, 503.1, 519, 523; 403/6, 7, 344, 373; 114/363

[56] References Cited

U.S. PATENT DOCUMENTS

| | | | |
|---|---|---|---|
| 939,389 | 11/1909 | Budd et al. | 248/159 |
| 1,179,393 | 4/1916 | Barry et al. | 403/344 X |
| 3,151,910 | 10/1964 | Larson | 114/363 X |
| 3,381,635 | 5/1968 | Pforr | 248/519 X |
| 3,794,279 | 2/1974 | Kramer | 248/523 |
| 4,587,921 | 5/1986 | Currey | 248/158 X |
| 4,977,848 | 12/1990 | Currey | 248/158 X |
| 5,197,406 | 3/1993 | Rabal et al. | 114/363 |

FOREIGN PATENT DOCUMENTS

| | | | |
|---|---|---|---|
| 183554 | 3/1955 | Austria | 248/523 |

OTHER PUBLICATIONS

The Springfield Marine Company 1995 Marine Products Catalog, Nixa, Missouri.

The Springfield Marine Company 1996 Marine Products Catalog, Nixa, Missouri.

*Primary Examiner*—Derek J. Berger

*Attorney, Agent, or Firm*—Beveridge, DeGrandi, Weilacher & Young, LLP

[57] ABSTRACT

A pedestal for receiving and fixing a shaft having a main body that has an upper reception portion and a lower base portion. The upper reception portion includes at least one side wall which defines a reception cavity for receiving the shaft. The side wall of the upper reception portion includes a gap which extends axially and a first and a second web positioned to opposite sides of the gap and on an interior surface of the side wall. The side wall includes a through-hole extending from the interior surface of the side wall and opening out an exterior surface of the side wall. The pedestal further includes a gap closing member which is supported by at least one of the webs and extends across the gap and is accessible by way of the through-hole such as via one end of the closing member. Preferably, an upper end of the upper reception portion is defined by a flange member extending inwardly from the exterior surface of the side wall so as to define a shaft reception opening having a common peripheral shape and essentially common peripheral cross-sectional area as a shaft to be inserted in the reception cavity. The invention also features a pedestal assembly that includes the pedestal, an attachment unit such as a boat, and a stem such as a boat seat, or the stem and pedestal alone.

32 Claims, 8 Drawing Sheets

PEDESTAL

FIELD OF THE INVENTION

The present invention relates to a pedestal that is designed for receiving and fixing a shaft stem such as a shaft stem for a boat seat, a shaft stem for an instrument control panel or other objects having a stem.

BACKGROUND DISCUSSION

Prior art pedestals designed for fixing stems of boat seats and the like typically have an upside-down bell or loudspeaker configuration with the wider portion designed for fixation with an underlying support and an upwardly extending portion for vertically receiving and fixing a shaft stem therein. On the outer periphery of the upper portion there is typically formed an extending gap or slot. On each side of the gap and extending longitudinally out from the periphery of the main body of the upper portion of the prior art pedestals there is provided a pair of lugs. These lugs, in combination with a fastener comprised of a bolt with handle, are used to squeeze the gap or slot closed and at the same time fixedly secure the inserted stem. In other words, after the shaft stem is inserted into a central hole in the upper portion of the pedestal, the bolt portion of the fastener extending through the legs is screwed down by turning the handle so as to reduce the size of the gap and correspondingly the diameter of the central opening so that the stem is fixed in position.

This arrangement, used in pedestals prior to that of the present invention, wherein the legs and bolt extended outside of the outer periphery of the upwardly extending upper portion, presents the problem of being easy to damage during manufacturing and transportation and also of presenting an obstacle which could hurt people or upon which devices could snag or become caught. Thus, the prior art designs present both a safety issue and a quality of manufacture issue.

SUMMARY OF THE INVENTION

The present invention is directed at solving the aforementioned problems by providing a pedestal which is less easily degraded during the manufacturing process and during transportation, does not present an obstacle which a person can knock into or get hung up on, and which securely locks the shaft stem in position. In so doing, the present invention features a pedestal for receiving and fixing a shaft which comprises a main body having an upper reception portion and a lower base portion. The upper reception portion includes at least one side wall defining a reception cavity for receiving the shaft. The side wall of the upper reception portion includes a gap which extends axially from an upper edge of the upper portion and a first and a second web positioned to opposite sides of the gap and on an interior surface of the side wall.

The side wall further includes a through-hole extending from the interior surface of the side wall and opening out an exterior surface of the side wall.

The pedestal further comprises a gap closing member which is supported by at least one of the webs and extends across the gap and has one end accessible by way of the through-hole. An upper end of the upper reception portion is preferably defined by a flange member extending inwardly from the exterior surface of the side wall so as to define a shaft reception opening having a common peripheral shape and essentially common peripheral cross-sectional area as a shaft to be inserted in the reception cavity. The webs extend axially with the gap and extend off from an undersurface of the flange in addition to along the inside surface of the side wall.

In a preferred embodiment, the web that is positioned between the through-hole and the gap includes an opening though which the gap closing member extends, and the second web, to the opposite side of the gap, receives the gap closing member such that the gap closing member is operable to lessen the width of the gap.

The gap closing member is preferably a threaded bolt and one or both of the webs feature a threaded opening and the through-hole shares a central axis with the threaded opening as well as an aligned hole in the other web.

The pedestal also features a side wall that defines a cylindrical shaped cavity and at least two additional ribs are arranged on an opposite half portion of the interior surface of the side wall. These additional ribs extend inwardly to a common degree as the webs positioned to opposite sides of the gap so as to define a cavity close to the exterior diameter of the shaft to be inserted and fixed. Preferably, the webs and ribs have concave shaped free edges to conform with the cylindrical shaped stem to be inserted into the reception cavity.

The upper end of the upper reception portion of the pedestal is therefore defined by a flange member that extends inwardly from the exterior surface of the side wall so as to define a circular shaft reception opening having a common peripheral shape and essentially common diameter as a shaft to be inserted into the reception cavity. The two webs adjacent the gap and the additional one or more ribs are spaced along a circumference of the interior wall surface and each of the webs and ribs extend inwardly a same amount as the flange member. There are preferably a total of 6 of the webs and ribs spaced along the interior wall surface.

A preferred embodiment of the invention features a bell or loudspeaker shaped pedestal with an arc-conical, hyperbolic exterior side surface which has a curvature that initiates either at the rim of the upper portion or at a lower end of a cylindrical shaped upper portion. The horizontal cross-sections of the pedestal increase in area progressively along a central vertical axis of the pedestal such that the base extends radially outward to a greater degree than does the upper reception portion. Also, the pedestal includes means for fixedly securing said base portion to an underlying support surface.

In one embodiment of the invention, the first and second webs are equally spaced from the gap (e.g., 10–35 mm).

Another embodiment of the invention features a pedestal wherein one of the web members is integral with and extends inwardly off from a boundary portion of the interior surface which defines the access opening in the side wall.

The invention also features a pedestal assembly that comprises a shaft member having an exterior surface and a pedestal having an upper reception portion which includes a reception cavity defined by a side wall. The side wall includes a gap and the pedestal further comprises means for opening and closing the gap which means is positioned internally within the reception cavity so as not to present an abutment that is positioned externally of an exterior surface of the pedestal.

The pedestal is particularly designed for arrangements wherein the shaft stem forms a lower portion of a boat seat and the pedestal further includes a base portion with means for securing the base portion to a boat deck or some other attachment unit. The assembly therefore can also include an attachment unit secured to a base portion of the pedestal. For instance, the attachment unit is a boat in one embodiment of the invention.

BRIEF DESCRIPTION OF THE DRAWINGS

The advantageous nature of the invention summarized above will become more apparent from the following detailed description of the invention and the accompanying drawings in which.

DETAILED DESCRIPTION OF THE PREFERRED EMBODIMENTS

Figure 1:
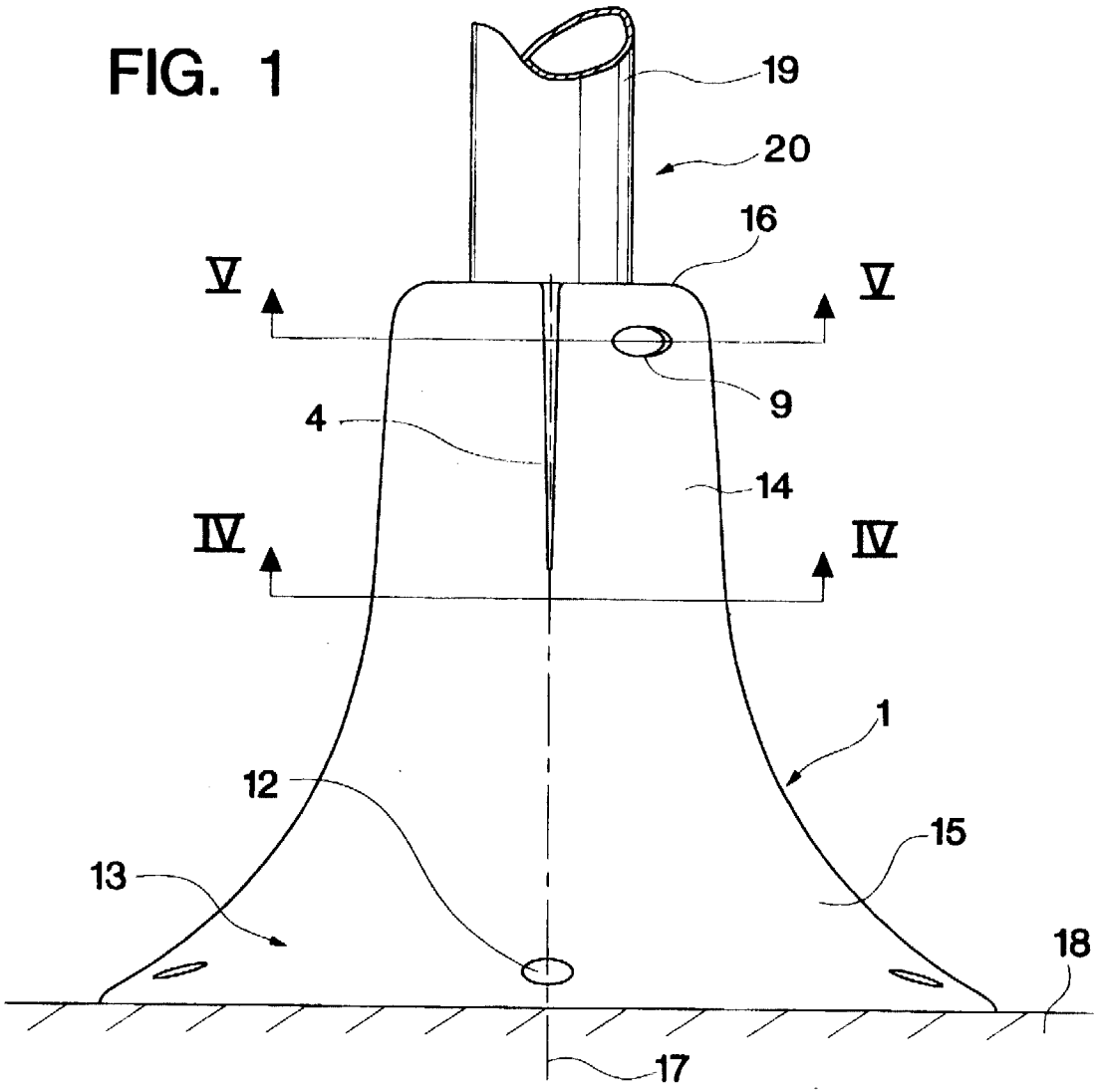
FIG. 1 shows a front elevational view of the present invention's pedestal receiving a stem and mounted on an underlying support surface provided by an attachment unit.

FIG. 1 shows a front elevational view of a preferred embodiment of the invention's pedestal assembly 20 comprised of pedestal 1, stem 19 and/or attachment unit 18. As shown in FIG. 1, pedestal 1 features main body 13 comprised of upper reception portion 14 and base portion 15. In the preferred embodiment shown in FIG. 1, pedestal 1 has a bell or loud speaker shape which includes an essentially cylindrical shaped upper portion 14 and an arc-conical base portion 15. Various other shapes are also possible under the present invention including an arrangement which is arc-conical from upper rim 16 to the bottom of the base, an arrangement wherein the pedestal has a venturi shape (which could facilitate initial insertion of a stem) as well as various other arrangements. Also base portion 15 extends radially out from central axis 17 a distance which is preferably about two to four times (most preferably three times) the maximum radial distance the upper reception portion's upper rim is from the central axis. Base portion 15 can also have alternative, interrupted peripheral configurations such as a cloverleaf or a tripod-like configuration (not shown) or the base can have a multisided configuration such as a quadrangle configuration.

Although shown to be cylindrical, stem 19 and the complimentary reception cavity can have alternative external configurations as long as the required clamping function in the upper portion of pedestal 1 described in greater detail below is achieved. FIG. 1 also shows base portion 15 as including a plurality of installation holes 12 spaced equally about a circumferential circle close to the outer extremity of the base portion (e.g., 6 at 60° spacing within an inch or two of the base's maximum outer periphery). Installation holes 12 provide locations where fasteners or the like (not shown) can be inserted to fix pedestal 1 in position with respect to the underlying surface presented by attachment unit 18. Stem 18 is representative of a variety of objects such as the stem of a chair or seat or an instrument panel.

The present invention is particularly designed for use as a support for a seat or instrument panel on a boat (e.g., a pleasure boat), because the secure manner of attachment, high degree of support and easy insertion and removal provided by the design of the present invention, makes it well suited for handling the large shock forces and vibrations which commonly develop on pleasure boats. The present invention can also be used in a plurality of other environments such as a base for a lamp, umbrella, etc., wherein at least some of the above noted features are important together with the feature of avoiding having any abutting element extending out away from the pedestal. Again, however, the design of the present invention is particularly well suited for use with boat seats and instrument panels attached to the deck of a boat.

FIG. 1 further shows gap 4 which extends axially down from upper rim 16 to a location close to cross-section line IV—IV which is approximately the location where the exterior surface of cylindrical upper portion 14 changes over to base portion 15. This changeover location is preferably about 40–50% (and more preferably 45%) of the total height of the pedestal down from upper rim 16. Gap 4 is preferably shaped so as to converge from a widest location at upper rim 16 to a convergent point or edge at its lower end. FIG. 1 also shows rim 16 curving upward and inward from an outer peripheral surface of upper portion 15. Access opening 9 is spaced to one side of gap 4 at a location preferably above the half-way mark vertically along the axially extending gap (e.g., the opening's center being 5–25% down with respect to the total height of pedestal 1).

Figure 2:
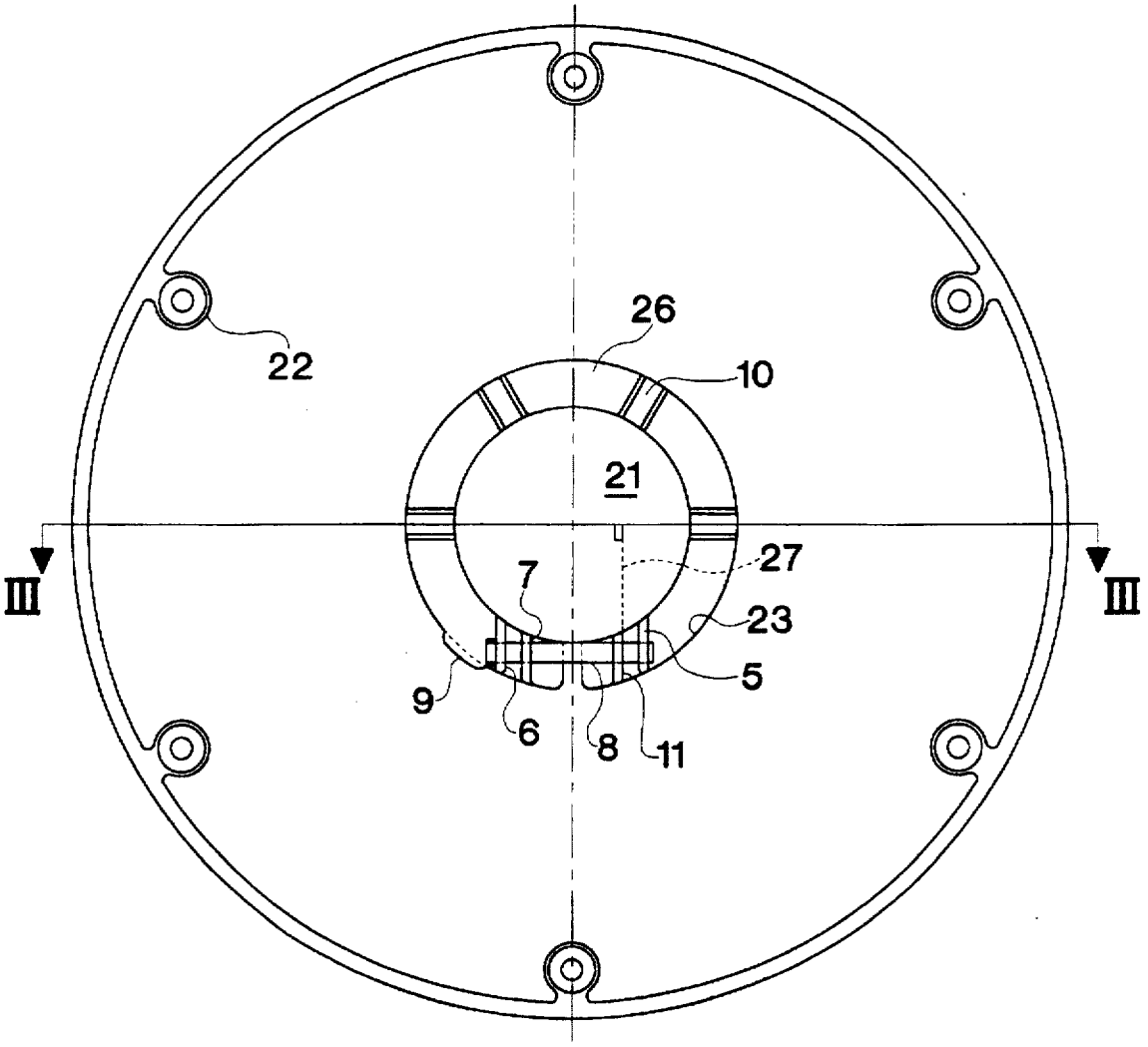
FIG. 2 shows a bottom plan view of the pedestal shown in FIG. 1.
Figure 3:
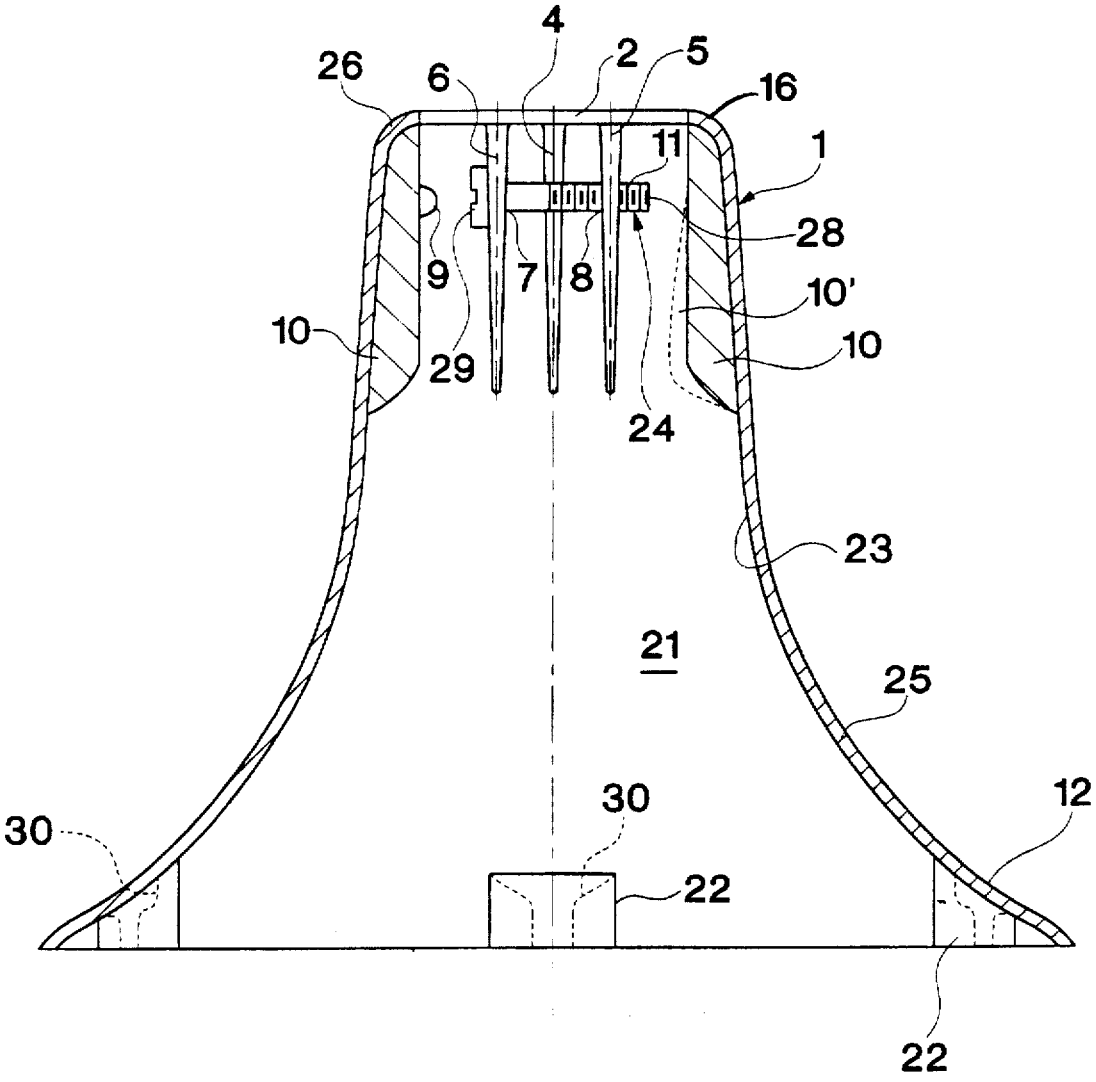
FIG. 3 shows a cross-sectional view taken along cross-section line III—III in FIG. 2.

FIGS. 2 and 3 illustrate the interior of pedestal 1. FIG. 2 provides a bottom view of pedestal 1 such that its hollow interior or reception cavity 21 can be seen. Upper portion 14 defines a narrower portion of cavity 21 while base 15 defines a less narrower portion of cavity 21. FIG. 2 also shows installation holes being provided by tab supports 22 which extend radially inward and feature a countersunk support surface 30 (FIG. 3) such that the head of a fixation member does not extend above the exterior surface of the base when in final position.

Figure 4:
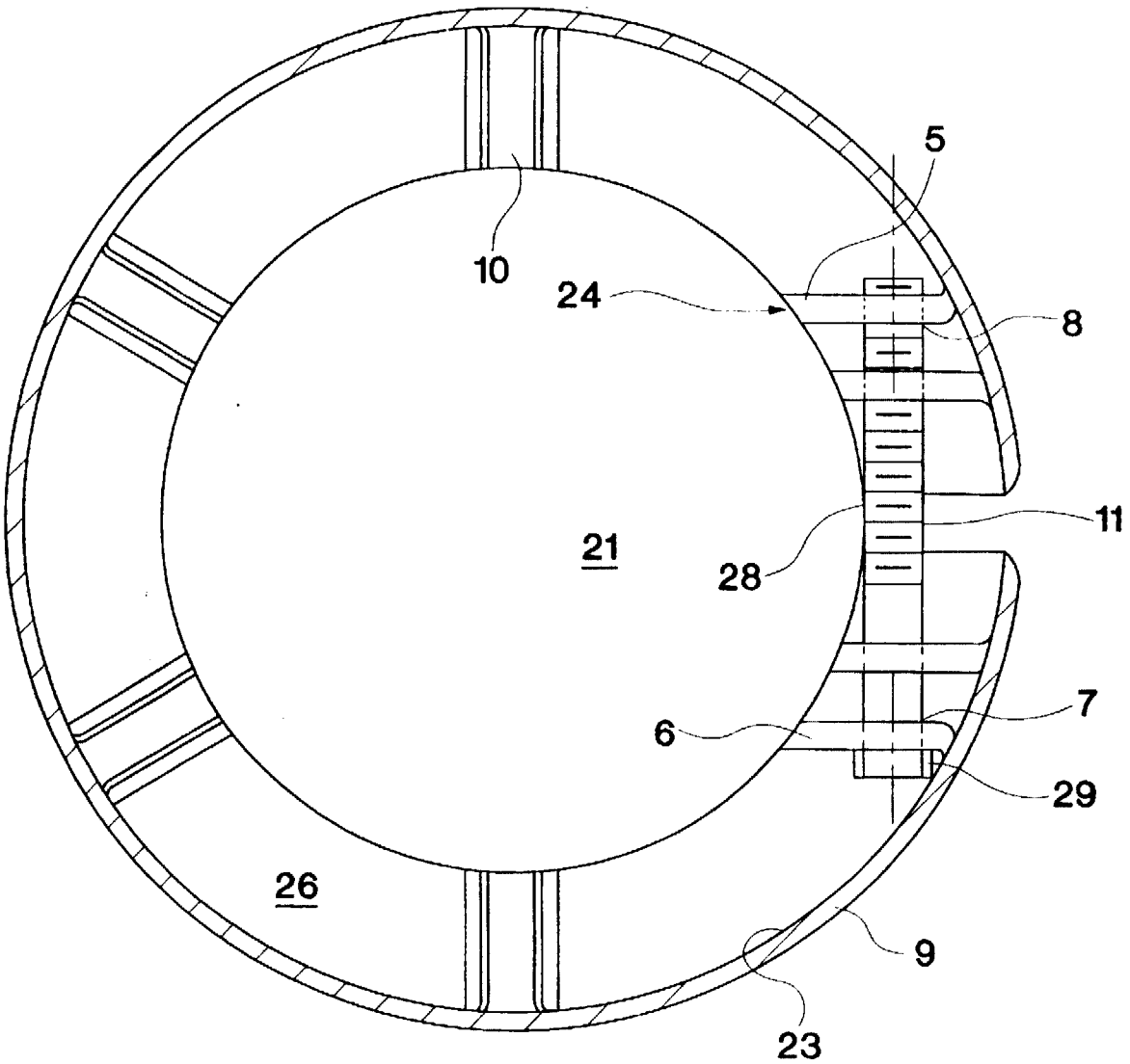
FIG. 4 shows a cross sectional view taken along cross-section line IV—IV in FIG. 1 (with the stem removed)

As shown in these Figures as well as FIG. 4 (which provides a cross-sectional view taken along cross-section line IV—IV), gap closing means 24 is provided so as to enable gap closing and opening to be carried out totally internally of the exterior surface of pedestal 1 so as to thereby avoid having potentially abutting extensions extending outward from the pedestal. In the embodiment of FIGS. 1–4, gap closure means is provided by webs 5 and 6 and their respective openings, in combination with opening 9 and gap closing member 11. Webs 5 and 6 are axially elongated members which preferably extend downward in the above noted range for gap 4 and preferably to an equal amount as gap 4. Webs 5 and 6 are shown to be supported on interior surface 23 of side wall 25 which in this case has a circular cross-section. In a preferred embodiment upper rim 16 of pedestal 1 features flange member 26 which extends radially inward to form a periphery which is essentially equal in diameter or slightly larger (e.g., a 1.0 to 10 mm spacing with respect to the stem once the stem is inserted). Webs 5 and 6 preferably each have an upper edge which is integral or otherwise secured to a bottom surface of flange member 26. In addition, webs 5 and 6 also preferably extend radially inward a distance equal to the depth the flange member extends radially inward and each has a concave stem abutment edge which conforms to the shape of the stem's exterior.

As shown in FIG. 2, in addition to webs 5 and 6 there is also positioned spacing ribs 10 which are spaced circumferentially inward about interior wall surface 23 and extend radially in the same manner as webs 5 and 6. Ribs 10 also extend for essentially the same length as webs 5 and 6 off from the undersurface of flange member 26. FIG. 2 also illustrates that ribs 10 also each have an interior edge which is contoured to conform to the curved exterior surface of the stem to be inserted.

FIG. 2 also illustrates that ribs 10 are oriented such that a vertical bi-secting plane passing through the ribs extends radially through the central axis of pedestal 1 while vertical planes bisecting webs 5 and 6 do not extend to the central axis, but extend so as to intersect in transverse fashion a bisecting plane extending along cross-section line III—III in FIG. 2. This transverse relationship is shown by dashed line 27 and the right angle box symbol in FIG. 2. This orientation of the webs allows for closure member 11 to extend essentially transversely with respect to webs 5 and 6 as shown in FIG. 3 and parallel with cross-section line III—III in FIG. 2. This relationship ensure that the clamping forces on the webs are directed essentially completely along the central axis of the bolt. Ribs 10 and webs 5 and 6 also have slightly tapering or converging side walls which provide a thicker upper region and a thinner lower region. The ribs 10 and webs 5,6 thus have a cross-section which is similar to gap 4.

FIGS. 2 and 3 show closure member 11 to be in the form of a threaded bolt with shaft 28 and head 29. Shaft 28 has a central axis which extends through the center point of hole 8 formed in web 5, hole 7 formed in web 6 and opening 9 which extends through side wall of pedestal 1. Also, in the embodiment shown in FIGS. 1–4, hole 7 is an unthreaded hole while hole 8 is threaded. Head 29 abuts web 6 such that upon rotation of bolt 11 in, for example, a clockwise direction, webs 5 and 6 are brought closer together to close gap 4. At the same time, the periphery defined by the free ends of webs 5, 6 and ribs 10 becomes smaller such that a previously inserted stem is frictionally fixed in position by webs 5, ribs 10 and, preferably, the inner edge of flange 26. Thus, once in its contracted state, the free end of ribs 10, webs 5 and 6 and, preferably, the inner edge of flange 26 form a ring which corresponds to the diameter of the shaft 19. An opposite rotation allows the gap to expand open again to its natural state.

Bolt 11 is shown as being threaded over the half section received by the threaded hole 7. In addition, opening 9 is sufficiently aligned with the holes 7 and 8 in webs 5,6 and made large enough to enable the insertion of a tool or the like designed for contact with the end of bolt 11 so that it can be rotated in one direction or the other.

In addition to ribs 10 having vertically oriented interior surfaces, the present invention also contemplates providing ribs 10 and webs 5 and 6 with interior surfaces which converge inwardly from a wider upper end to a smaller periphery intermediate and lower end. One possible oblique orientation for the ribs and webs is represented by rib 10' shown in dashed lines in FIG. 3. Preferably the obliquely oriented ribs and webs have a lower half portion which is essentially vertically oriented. In this way, initial assertion is facilitated while the prevention of tilting of the stem is also achieved.

Figure 5:
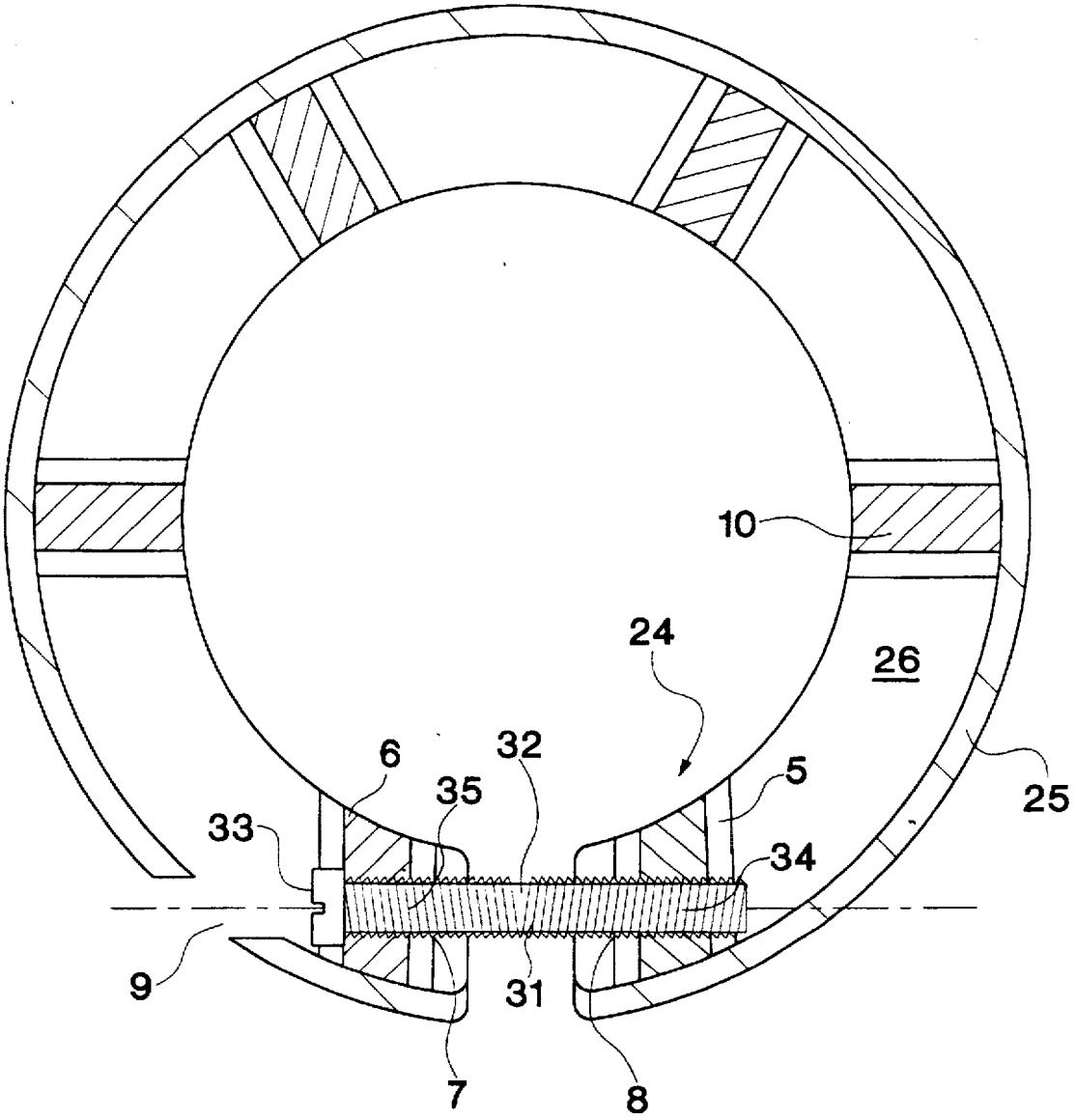
FIG. 5 shows a first embodiment of the closure means of the present invention taken along cross-section line V—V in FIG. 1 (with the bolt not cross-sectioned for illustration purposes)

FIG. 5 illustrates an alternate embodiment of closure means 24. As shown in FIG. 5, gap closure means 24 includes bolt 31 having shaft 32 and head 33. Shaft 32 is different from the earlier described embodiment in that it has two oppositely threaded shaft sections 34,35 and both holes 7 and 8 are threaded such that rotation of bolt 31 acts to simultaneously close the gap from both sides.

Figure 6:
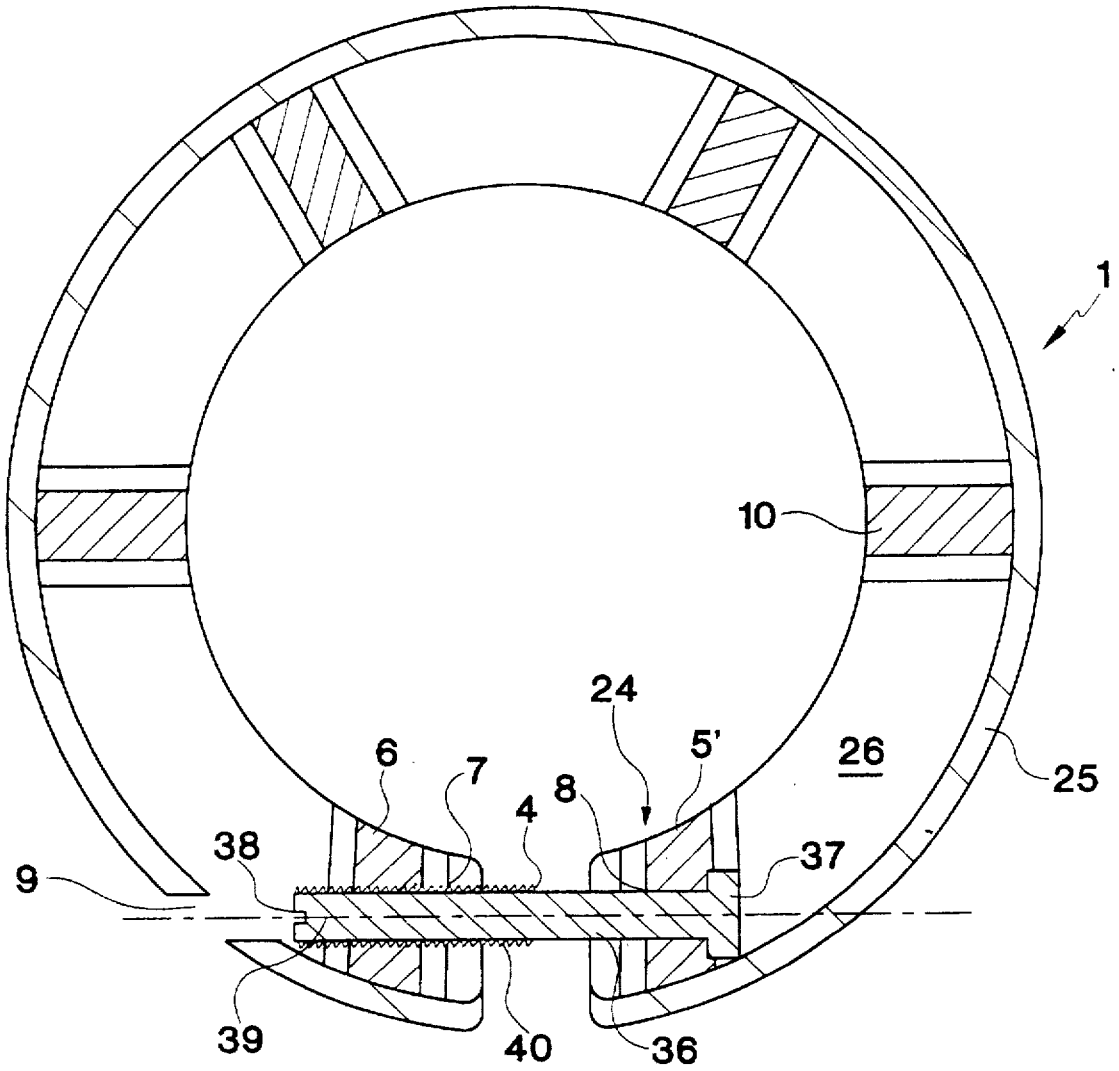
FIG. 6 shows a second embodiment of the closure means of the present invention in a pre-fixation mode.
Figure 7:
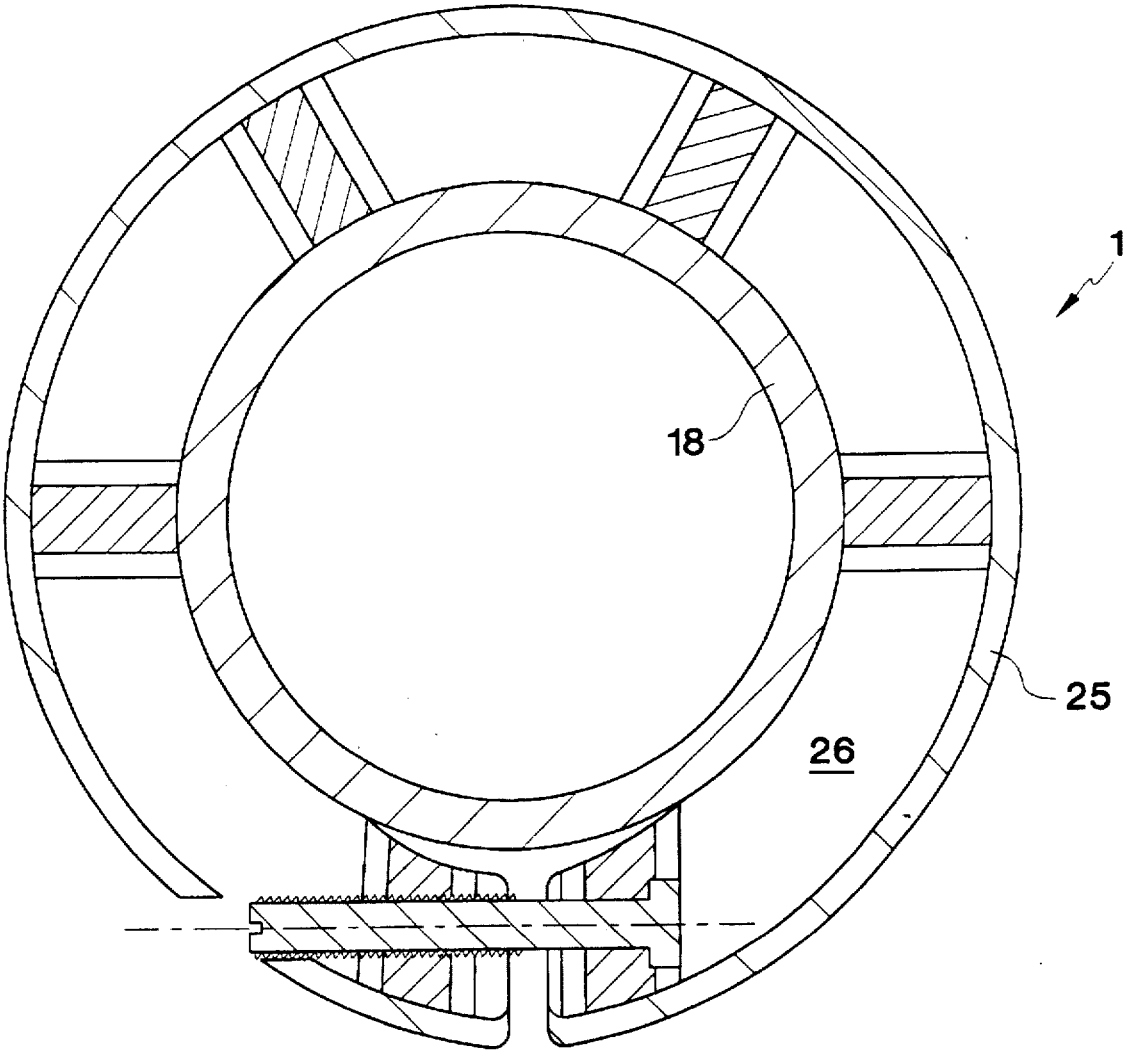
FIG. 7 shows the second embodiment of the present invention in a post-fixation position with respect to an inserted shaft.

FIGS. 6 and 7 show a further embodiment of closure means 24 of the present invention as well as the positioning of webs 5,6 and ribs 10 both before and after insertion and fixing in position of stem 18. FIG. 6 shows pedestal 1 prior to insertion of a stem with gap 4 in a relatively wide state. FIG. 6 also shows a further embodiment for closure means 24 which comprises bolt 36 having head 37 received within a recess formed in web 5'. Web 5' also includes non-threaded hole 8 while web 6' has threaded hole 7 aligned with opening 9. Bolt 36 includes a tool receiving notch or the like at an end opposite to head 37 and threaded shaft portion 40 threadably received by web 5.

As shown in FIG. 7, upon a rotation of bolt 36 in a first direction, gap 4 is lessened in width whereupon the interior edge of flange 26 and the inner ends of webs 5', 6' and ribs 10 are compressed against the outer surface of shaft 18 so as to frictionally, axially and rotatively lock shaft 18 in position with respect to pedestal 1.

Figure 8:
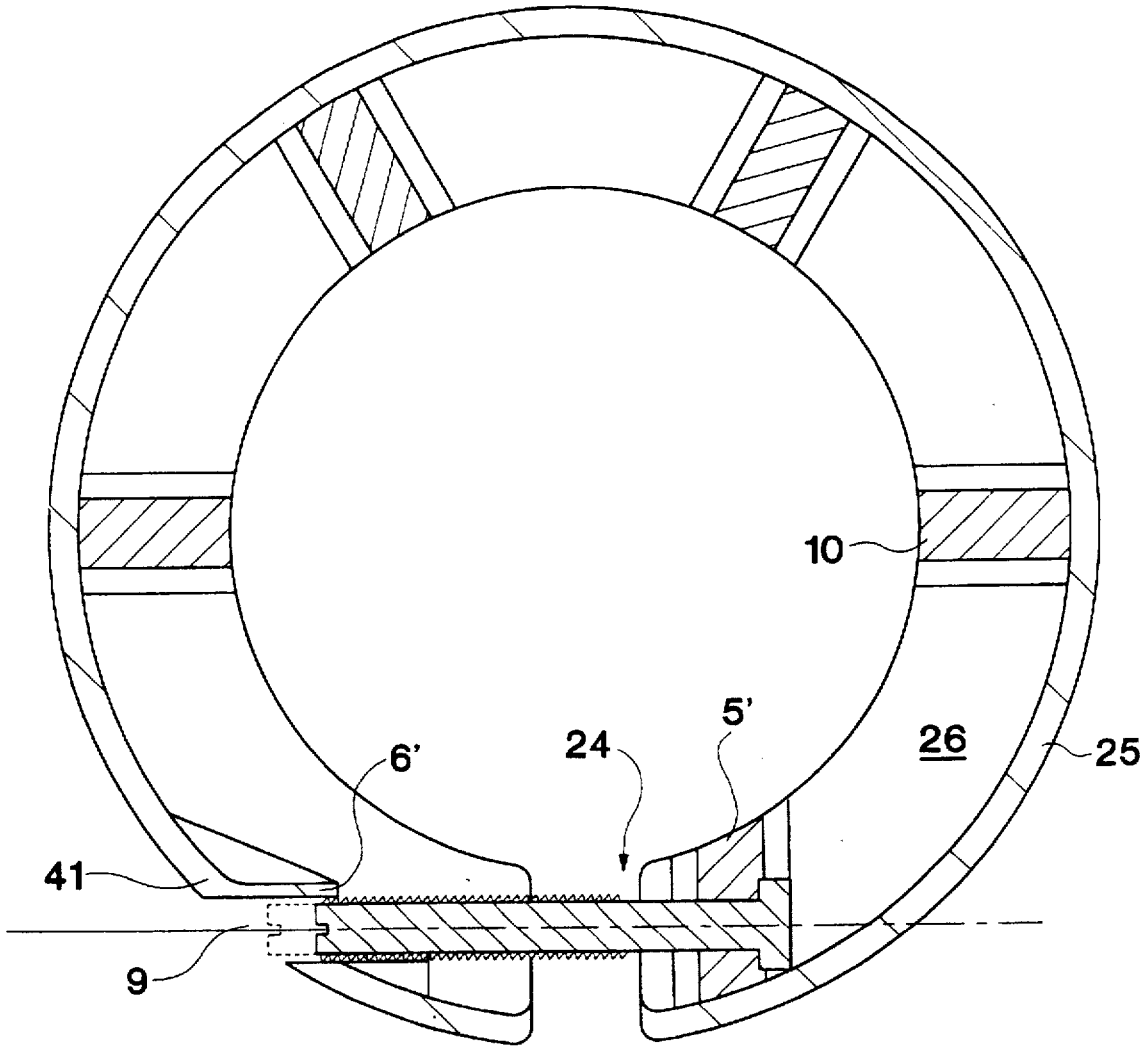
FIG. 8 shows a third embodiment of the closure means of the present invention.

FIG. 8 shows yet another preferred embodiment of gap closure means 24, although a variety of other forms can also be relied upon which achieve the gap closing function while avoiding the positioning of any component thereof external to the exterior surface of the pedestal's main body. As shown in FIG. 8, the gap closure means includes an arrangement similar to that of FIG. 7 except it has modified web 6' which is integral with portion 41 of side wall 25 which defines opening 9. Web 6' features a threaded extension of opening 9 (which can also be threaded) which extends sufficiently long enough so as to allow for fixing closure of gap 4 while avoiding the rotated end of the bolt from extending externally to the exterior surface of the pedestal (or at an extension out that is at least within one cm thereof). Web 6' can either be cylindrical in shape and not extend up into contact with flange member 26, or for extra strength, can have a portion which extends all the way up to flange member 26, or can have an elongated shape similar to webs 6' which extends up to the flange member and below.

The Chinese priority application no. 96 2 29481.0 filed Mar. 19, 1996 is hereby incorporated by reference in its entirety.

Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A pedestal for receiving and fixing a shaft, comprising:

a main body having an upper reception portion and a lower base portion, said upper reception portion including at least one side wall defining a reception cavity for receiving the shaft, said side wall of said upper reception portion having a gap formed therein, and said upper reception portion further comprising a first and a second web positioned to opposite sides of said gap and on an interior surface of said side wall, said side wall further comprising a through-hole extending from the interior surface of said side wall and opening out at an exterior surface of said side wall; and a gap closing member which is supported by at least one of said webs and extends across said gap and is accessible by way of said through-hole.

2. A pedestal as recited in claim 1 wherein an upper end of said upper reception portion is defined by a flange member extending inwardly with respect to the exterior surface of said side wall so as to define a shaft reception opening.

3. A pedestal as recited in claim 2 wherein said webs extend off from an undersurface of said flange member in addition to along the interior surface of said side wall.

4. A pedestal as recited in claim 3 wherein said first web, which is positioned between said through-hole and said gap, includes an opening though which said gap closing member extends, and the second web to the opposite side of said gap receives said gap closing member such that said gap closing member is operable to lessen the width of said gap.

5. A pedestal as recited in claim 4 wherein said gap closing member is a threaded bolt and one of said webs features a threaded opening and said through-hole shares a central axis with said threaded opening.

6. A pedestal as recited in claim 1 wherein said web, which is positioned between said through-hole and said gap, includes an opening though which said gap closing member extends, and the second web to the opposite side of said gap receives said gap closing member such that said gap closing member is operable to lessen the width of said gap.

7. A pedestal as recited in claim 6 wherein said gap closing member is a threaded bolt and one of said webs features a threaded opening and said through-hole shares a central axis with said threaded opening.

8. A pedestal as recited in claim 1 wherein said side wall defines a cylindrical shaped cavity and at least two ribs are arranged, with respect to said webs, on an opposite half portion of the interior surface of said side wall, said ribs extending inwardly to a common degree as said webs positioned to opposite sides of said gap.

9. A pedestal as recited in claim 8 wherein said webs have concave shaped free edges to conform with a cylindrical shaped stem shaft to be inserted into said reception cavity.

10. A pedestal as recited in claim 1 wherein an upper end of said upper reception portion is defined by a flange member extending inwardly with respect to the exterior surface of said side wall so as to define a circular shaft reception opening, and said pedestal including at least one rib positioned on said side wall generally opposite to said webs, and said webs and ribs being spaced along a circumference of said interior wall surface and each of said ribs and webs extending inwardly a same amount as said flange member.

11. A pedestal as recited in claim 10 wherein there are a total of 6 of said webs and ribs spaced along said interior wall surface.

12. A pedestal as recited in claim 1 wherein horizontal cross-sections of said pedestal increase in area progressively along a central vertical axis of said pedestal such that said base portion extends radially outward to a greater degree than does said upper reception portion and said base has means for fixedly securing said base portion to an underlying support surface.

13. A pedestal as recited in claim 1 wherein said first and second webs are equally spaced from said gap.

14. A pedestal as recited in claim 1 wherein said webs are spaced 10–35 mm from said gap.

15. A pedestal as recited in claim 1 further comprising rib members extending radially inward from the interior surface of said side wall, and said rib members being spaced sufficiently circumferentially apart so as to be free from contact with each other when the shaft is fixed by said pedestal.

16. A pedestal as recited in claim 1 wherein said gap is defined by a pair of side wall edges, and said first web is spaced apart from a first of said pair of side wall edges which is closest to said first web, and said second web is spaced apart from a second of said pair of side wall edges which is positioned closest to said second web.

17. A pedestal as recited in claim 1 wherein said upper reception portion has a continuous, single circle peripheral cross-section except for said gap.

18. A pedestal for receiving and fixing a shaft, said pedestal comprising an upper portion and a base portion, said upper portion including at least one side wall defining a reception cavity for receiving the shaft, and said side wall having a gap extending from an upper rim of said upper portion to a location therebelow, and said pedestal further comprising a first web member to one side of said gap and a second web member to an opposite side of said gap, and said web members being supported on an interior surface of said side wall, and said side wall further including an opening which extends through said side wall;

said pedestal also comprising a gap closing member which is supported by said web members and which is accessible through said opening which extends into said reception cavity; and said pedestal further comprising at least two ribs which extend radially inward from the interior surface of said side wall and are circumferentially spaced apart from each other to avoid having one rib in contact with another when the shaft is received and fixed by said pedestal.

19. A pedestal as recited in claim 18 wherein said first and second web members are elongated web members that extend parallel with said gap, and each of said web members including a recess or hole for receiving the gap closing member, and the opening in said side wall and the recess or hole in said web members share a common central axis, and said upper portion has an upper flange which defines, on an inner edge thereof, a shaft reception opening which shares a common central axis with said reception cavity and each of said web members has an upper end in contact with an under surface of said upper flange, and each of said web members extends radially inward an equal distance.

20. A pedestal as recited in claim 19 wherein at least one of said recess or hole in said web members is threaded and said gap closing member has a threaded shaft.

21. A pedestal as recited in claim 18 wherein said at least two ribs extend radially inward from the interior surface of said side wall to a common extent as said web members, and said rib members have internal edges which are positioned for contact with the shaft.

22. A pedestal as recited in claim 21 wherein both of said web members have threaded holes.

23. A pedestal as recited in claim 18 wherein said web members are spaced to each side of said gap such that one of said web members is spaced from a boundary portion of said side wall which defines said opening.

24. A pedestal as recited in claim 18 wherein one of said web members is integral with and extends inwardly off from a boundary portion of said interior surface which defines said opening in said side wall.

25. A pedestal as recited in claim 18 wherein, when said gap is in an open state, said ribs and web members are arranged such that a bisecting, vertical plane extending through one of said ribs extends more in a direction toward a central axis of said upper portion than does a bisecting, vertical plane extending through one of said web members.

26. A pedestal assembly, comprising:

a shaft member having an exterior surface;

a pedestal having an upper reception portion and a lower base, and said upper reception portion includes a reception cavity defined by a side wall of said pedestal, said side wall including a gap which opens out at an upper rim of said side wall and extends downward for only a portion of a distance from the upper end of said side wall to a lower end of said base, and said pedestal further comprising means for closing said gap which means is positioned internally within said reception cavity so as not to present an abutment positioned externally of an exterior surface of said upper portion, and said means for closing said gap, upon completion of a closing mode of operation, fixes said pedestal to said shaft member.

27. A pedestal assembly as recited in claim 26 wherein said gap converges from a widest end the at an upper rim of said side wall to a closed end, said means for closing said gap includes a pair of web members to opposite sides of said gap, and said web members converge in thickness from a thicker upper end to a thinner lower end.

28. A pedestal assembly as recited in claim 26 further comprising rib members extending radially inward from an interior surface of said side wall, and said rib members being spaced sufficiently circumferentially apart to as to be free from contact with each other when the shaft member is fixed by said pedestal.

29. A pedestal assembly as recited in claim 26 wherein said gap is defined by a pair of side wall edges and said means for opening and closing said gap includes a pair of web members with each web member being spaced apart from each of said side wall edges.

30. A pedestal assembly, comprising:

a shaft member having an exterior surface;

a pedestal having an upper reception portion which includes a reception cavity defined by a side wall, said side wall including a gap, and said pedestal further comprising means for opening and closing said gap which means is positioned internally within said reception cavity so as not to present an abutment positioned externally of an exterior surface of said upper portion and said means for opening and closing said gap, upon completion of a closing mode of operation, fixes said pedestal to said shaft member, and wherein said shaft member forms a lower stem portion of a boat seat and said pedestal further includes a base portion with means for securing said base portion to a boat deck.

31. A pedestal assembly, comprising:

a shaft member having an exterior surface;

a pedestal having an upper reception portion and a lower base, and said upper reception portion includes a reception cavity defined by a side wall of said pedestal, said side wall including a gap, and said pedestal further comprising means for opening and closing said gap which means is positioned internally within said reception cavity so as not to present an abutment positioned externally of an exterior surface of said upper portion, and said means for opening and closing said gap, upon completion of a closing mode of operation, fixes said pedestal to said shaft member, and said base includes mounting means for facilitating securement of said base to an underlying surface.

32. A pedestal assembly as recited in claim 31 wherein said base has a larger periphery than said upper reception portion with said base and reception portion representing a monolithic member, and said mounting means including a plurality of fastener holes formed in said base.

* * * * *